US006415565B1

(12) United States Patent
Sosa

(10) Patent No.: US 6,415,565 B1
(45) Date of Patent: Jul. 9, 2002

(54) STORM RAIL FOR SLIDING DOOR

(75) Inventor: Jesus M. Sosa, Rio Piedras, PR (US)

(73) Assignee: Vent-Alarm Corporation, Gurabo, PR (US)

( * ) Notice: Subject to any disclaimer, the term of this patent is extended or adjusted under 35 U.S.C. 154(b) by 0 days.

(21) Appl. No.: 09/551,660

(22) Filed: Apr. 18, 2000

(51) Int. Cl.[7] ..... E06B 1/04

(52) U.S. Cl. ..... 52/207; 52/75; 52/200; 52/455; 292/4; 292/5

(58) Field of Search ..... 292/16, 183, 42, 292/35, 40, 4, 3; 52/75, 200, 202, 207; 70/467

(56) References Cited

U.S. PATENT DOCUMENTS

| | | | | | |
|---|---|---|---|---|---|
| 3,984,135 | A | * | 10/1976 | Dathe et al. | 292/4 |
| 4,135,376 | A | | 1/1979 | Evans et al. | 79/100 |
| 4,475,313 | A | | 10/1984 | Governale | 49/370 |
| 4,509,291 | A | | 4/1985 | Geisthardt | 49/409 |
| 4,643,005 | A | * | 2/1987 | Logas | 70/95 |
| D294,454 | S | * | 3/1988 | Loudenslager | D8/341 |
| 4,798,407 | A | | 1/1989 | Miller | 292/229 |
| 4,819,297 | A | | 4/1989 | Jacobs et al. | 16/87 |
| 4,891,921 | A | * | 1/1990 | Governale | 52/207 |
| 5,110,164 | A | * | 5/1992 | Whiteman et al. | 292/4 |
| 5,113,629 | A | * | 5/1992 | Carrick | 52/207 |
| 5,660,420 | A | * | 8/1997 | Smith et al. | 292/3 |
| 5,791,173 | A | * | 8/1998 | Montes | 70/101 |
| 5,855,041 | A | | 1/1999 | McMichael | 16/91 |
| 5,927,017 | A | | 7/1999 | Jacobs | 49/410 |
| 5,964,061 | A | | 10/1999 | Hughes et al. | 49/425 |
| 6,070,918 | A | * | 6/2000 | Calvache, Jr. | 292/DIG. 46 |
| 6,167,655 | B1 | * | 1/2001 | Santa Cruz et al. | 49/407 |

* cited by examiner

*Primary Examiner*—Carl D. Friedman
*Assistant Examiner*—Basil Katcheves
(74) *Attorney, Agent, or Firm*—Duane Morris LLP

(57) ABSTRACT

A support brace is provided for structurally linking a sliding door to a surrounding structure. The support brace includes an elongate rail having a first end and a second end. The rail is fastened to a portion of the sliding door in spaced relation to the surrounding structure so that the first end is positioned adjacent to a top edge of the sliding door and the second end is positioned adjacent to a bottom edge of the sliding door. At least one bolt is slidingly secured to the rail, and includes a locking rod. The bolt is arranged so that it can be slid along the rail between a first position, where the locking rod projects beyond one of the first and second ends of the rail, and a second position where one of the first and second ends of the rail projects beyond the locking rod. At least one lock plate is also provided that includes an opening defined through a portion of the plate. The opening is arranged in aligned relation to the locking rod so that when the bolt is slid from the second position to the first position, the locking rod is received in the opening.

14 Claims, 6 Drawing Sheets

STORM RAIL FOR SLIDING DOOR

FIELD OF THE INVENTION

The invention relates generally to reinforcement of sliding closures, and more particularly concerns structural reinforcement of patio doors and the like, against structural failure caused by wind pressure oriented in a direction perpendicular to a sliding track of the door.

BACKGROUND OF THE INVENTION

Sliding doors are commonly used in residential dwellings, apartment units, etc., in a range of types. Such doors may have one movable panel or more. The panel(s) may abut or may lap one another. One of the panels may be fixed and immovable and another may be slidable in a track. The fixed panel and the movable panels may have the same appearance, such as two framed glass panels, or May have a different appearance. Some sliding panels are received in a wall "pocket" at least in one of their possible positions.

In a common structural arrangement known as a patio door, one, two or more framed glass panels are provided in a framed opening, typically leading outdoors to a concrete patio if on the ground level or to a deck if on an upper level. Typically, two (or more) panels are movable and lap one another when the door is open. The panels are typically identical framed glass panels, slidable in parallel adjacent tracks in an upper header and in a lower sill. However, it is also possible that two panels may butt against one another and move in the same track. Another possibility is a door having a stationary glass panel and a movable sliding panel that can lap the stationary one when the door is open.

A feature common to the sliding panels in all the foregoing possible door types is that the structures that engage and hold the movable panel in the doorway are the same structures that permit the movable panel to slide back and forth to open and close the door.

For an exemplary glass patio door, one or more relatively large glass panes (e.g., 80 inches high by 36 inches wide, or approx. 200 cm high by 100 cm wide) are mounted in a surrounding metal or wooden frame having parallel tracks in which the edges of the panels fit and are adapted for horizontal sliding movement. The weight of the panel most often is carried on a lower track or rail. The lower track or rail can be channel shaped to receive wheels or tenons or the like that extend from the bottom edge of the door panel, or the track can have a rail or ridge or the like that fits into a channel along the lower edge of the door panel.

Instead of resting by gravity on the lower track or rail, a sliding panel also can be hung by a sliding or rolling mechanism from an upper track. Whether the mounting is from the top rail or the bottom one, the panels frequently require the capability of vertical displacement so that the panel can be installed in its sliding track and if necessary removed. For this purpose, the upper rail may have sufficient vertical clearance that the panel can be displaced upwards from its operative position into the upper rail, for lifting the panel structures over their mating structures in the lower rail and permitting the panel to be placed in the doorway opening or removed. A similar vertical displacement may be needed in doors hung from an upper header rail, to allow a panel to be lifted to disengage the mechanism on which the panel hangs and slides.

An exterior panel may be constructed without this vertical displacement capability because as a security measure it could be ill advised to have an exterior door panel that is very easy to defeat. Nevertheless, whether or not the panels are removable, it is an aspect of sliding doors that the advantage of sliding capability comes with the disadvantage that there is only limited structural connection between the movable panel and the upper header track and/or lower sill track. There may be no load bearing connection other than the fact that the upper and lower edges of the panel and/or track comprise channels having a given depth, with the sidewalls of the channel confining the panel. In some instances the only resistance to a load applied in a direction perpendicular to the plane of the panel is that there are rollers or wheels on one side that roll in a shallow track or groove on the other side. This mechanical structure cannot withstand a great deal of force in a direction perpendicular to the plane of the panel.

In the usual patio door arrangement, a vertical stile along one side edge of the sliding door carries a lock assembly to prevent the panel from sliding away from the jamb when locked, namely in the plane of the panel. A horizontal bottom rail normally includes a roller assembly that is arranged for sliding or rolling engagement with a lower track or rail located in the sill of the door (or vice versa). The lock assembly normally includes a hook-shaped mortise latch for engaging a mating latch keeper mounted on the adjacent door jamb to lock the door against movement to an open position. The roller assembly is normally constructed to provide easy, back-and-forth, horizontal sliding movement of the door. It is inconsistent with the objective of an easily opened door to provide any substantial structural support or a structural tie between the sliding door panel and its fixed framework.

Thus, some prior art sliding doors have been constructed to include a structural connection with the surrounding frame, and with a mid-overlapping edge. These doors often include deep channel structures that are securely attached to the wall of the building so that the door(s) are securely engaged around their peripheral edges. This solution is much more costly to implement, cannot normally be accomplished in a retrofit of an existing door, and still does not address a significant weak point in their design, i.e., the mid-overlapping edges, where the door panels are spaced from the wall of the building. This disadvantage renders such doors especially vulnerable to large forces applied to the door, in a direction perpendicular to the plane of the door. This vulnerability is due to the rolling engagement of the edges of the panels on the sill. The lack of any type of rigid connection or general support at the mid-overlapping edges of the doors often leads to failure under heavy wind loading.

As a result, pressure that is applied to the door, from a direction other than the sliding direction of the door, may be only weakly opposed by the door structure. This condition can lead to catastrophic failure of the door in high wind conditions, e.g., during a hurricane, tornado or other severe weather condition. In this failure mode, the engagement between the rollers and the track may be insufficient to withstand the substantial inward wind pressure and/or outward suction on the door, or the associated vibration of a gusting wind. In this case, the rollers may be dislodged from their engagement with the track, jamming the door or in a severe case disengaging the movable panel entirely from its sliding frame. This can lead to collateral damage to the building or could require costly repair procedures including disassembly or even total replacement of the sliding doors.

As a measure against breaking and entering more than against wind pressure, it is known to employ latch bar mechanisms in cooperation with sliding glass-type doors. These locking or fastening devices may secure the sliding glass units to adjoining frame members to keep them closed, for example a spacer bar can be inserted into the track between a movable panel and the vertical frame or stile member toward which the panel would slide in opening the door. In that case, the structure of the stile also supports the sliding panel, and the sill or bottom rail may have a channel that encompasses the vertical side edge of the movable panel.

As another possibility, a security mechanism can be structured to lock together or to secure together two sliding glass panel units. In an unlocked state the panels are unattached and are capable of sliding relative to each other and relative to the frame in which they are mounted. A bar or rod positioned in a door channel between the door panel and the vertical frame will prevent opening of the sliding door as discussed above. Similarly, by sliding two movable panels in adjacent tracks against opposite vertical frame members of the doorway and then attaching the panels together where they overlap, neither panel can slide back out of abutment with its respective vertical frame member and the panel is locked. However, this effectively doubles the area of the panel subjected to any wind force, without substantially improving the structural engagement of the panels in their tracks. Such devices may be useful to prevent burglaries begun by forcing movable panels open in their tracks, but are less then completely effective in structurally supporting the door panels against displacement or detachment from their tracks.

SUMMARY OF THE INVENTION

The present invention provides a support brace, referred to as a storm rail, for structurally linking a sliding door to a surrounding structure, and which may be retrofitted to an already installed sliding door structure. In one embodiment the support brace includes an elongated rail having a first end and a second end, with the rail being abutted against and preferably fastened to a portion of the sliding door in spaced relation to the surrounding structure so that the first end is positioned adjacent to a top edge of the sliding door and the second end is positioned adjacent to a bottom edge of the sliding door. At least one bolt is slidingly secured to the rail, and includes a locking rod. The bolt is arranged so that it can be slid along the rail between a first position wherein the locking rod projects beyond one of the first and second ends of the rail, and a second position wherein one of the first and second ends of the rail projects beyond the locking rod. At least one lock plate is also provided that includes an opening defined through a portion of the plate. The opening is arranged in aligned relation to the locking rod so that when the bolt is slid from the second position to the first position, the locking rod is received in the opening.

In an alternative embodiment of the invention, a support brace for structurally linking a sliding door to a surrounding structure is provided having two rails. Each rail has a first end and a second end, and is fastened to a portion of the sliding door in spaced relation to the surrounding structure so that the first end of one of the rails is positioned adjacent to a top edge of the sliding door and a first end of the other of the rails is positioned adjacent to a bottom edge of the sliding door. At least one bolt is slidingly secured to each of the rails. The bolts each include a locking rod wherein the bolt can be slid along the rail between a first position wherein the locking rod projects beyond one of the first end of the rail, and a second position wherein one of the first end of the rail projects beyond the locking rod. Two lock plates are also provided, each including an opening defined through a portion of the plate. Each of the openings is arranged in aligned relation to one of the locking rods so that when the bolt is slid from the second position to the first position, the locking rod is received in the opening.

A storm resistant sliding door assembly is also provided that includes two sliding doors each including a pair of spaced-apart vertical stiles, a horizontal top rail, a horizontal bottom rail, a roller assembly, and a centrally positioned pane of glass. An elongate rail, having a first end and a second end, is fastened to a vertical stile of one of the sliding doors so that the first end is positioned adjacent to the horizontal top rail of the sliding door and the second end is positioned adjacent to the horizontal bottom rail of the sliding door. At least one bolt is slidingly secured to the rail, and includes a locking rod wherein the bolt can be slid along the rail between a first position wherein the locking rod projects beyond the horizontal bottom rail of the sliding door, and a second position wherein the locking rod is spaced from the horizontal bottom rail. At least one lock plate is also provided that includes an opening defined through a portion of the plate. The opening is arranged in aligned relation to the locking rod so that when the bolt is slid from the second position to the first position, the locking rod is received in the opening.

BRIEF DESCRIPTION OF THE DRAWINGS

These and other features and advantages of the present invention will be apparent from the following detailed description of preferred embodiments of the invention, which is to be considered together with the accompanying drawings wherein like numbers refer to like parts and further wherein.

DETAILED DESCRIPTION OF THE PREFERRED EMBODIMENTS

Figure 1:
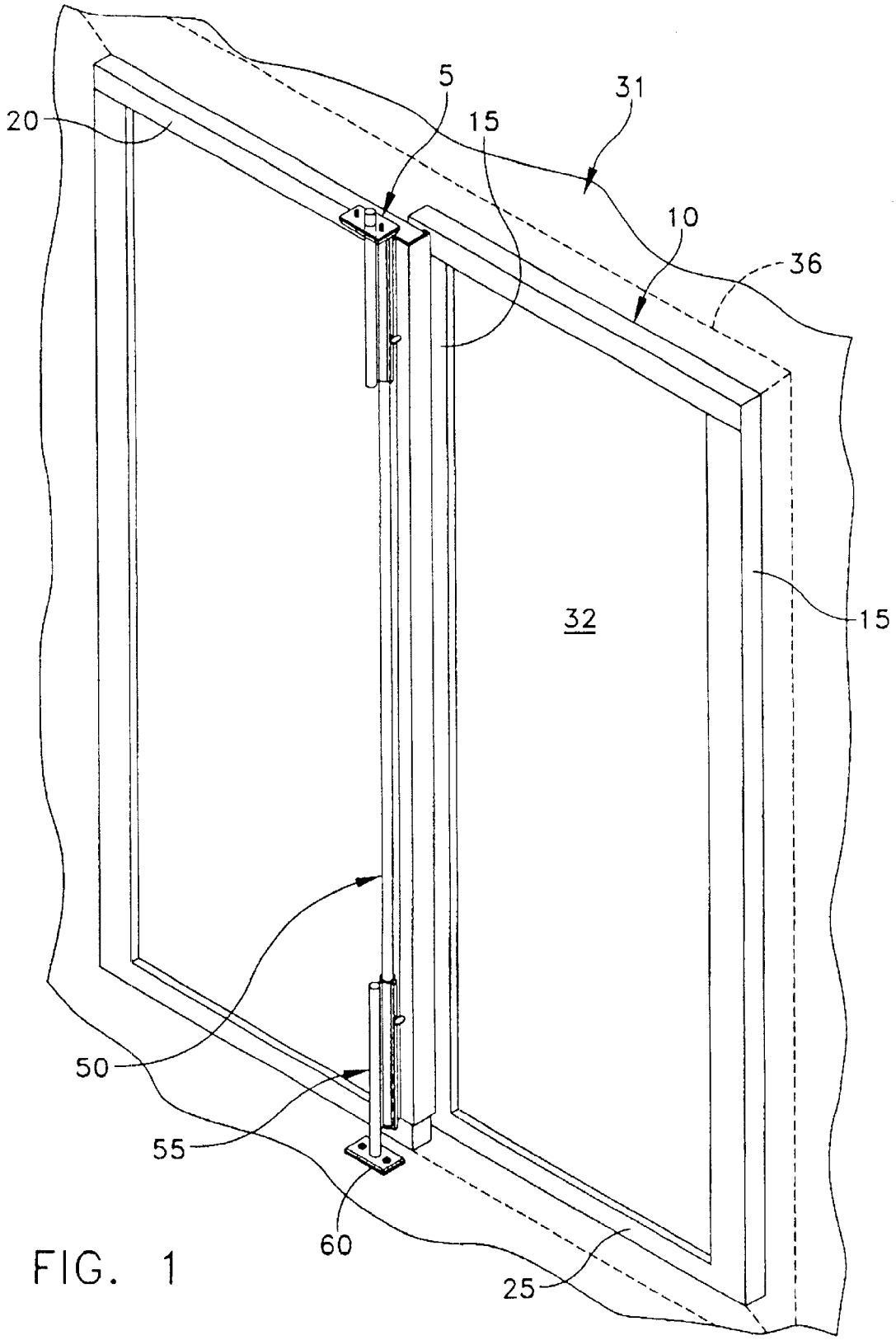
FIG. 1 is a perspective view of a sliding door including a storm rail support brace formed in accordance with the present invention.

This description is intended to be read in connection with the accompanying drawings, which are encompassed in the entire written description of the invention. Relative terms in the description such as "horizontal," "vertical," "up," "down," "top" and "bottom" as well as derivatives thereof (e.g., "horizontally," "upwardly," etc.) should be construed to refer to the orientation as then described or as shown in the drawing figure under discussion. These relative terms are for convenience of description and normally are not intended to require a particular orientation. Terms including "inwardly," "outwardly," "longitudinal," "lateral" and the like are to be interpreted relative to one another or relative to an axis of elongation, or an axis or center of rotation, as appropriate. Terms concerning attachments, coupling and the like, such as "connected" and "interconnected," refer to a relationship wherein structures are secured or attached to one another either directly or indirectly through intervening structures, as well as both movable or rigid attachments or relationships, unless otherwise mentioned. The term "operatively connected" is such an attachment, coupling or connection that allows the pertinent structures to operate as intended by virtue of that relationship.

Figure 2:
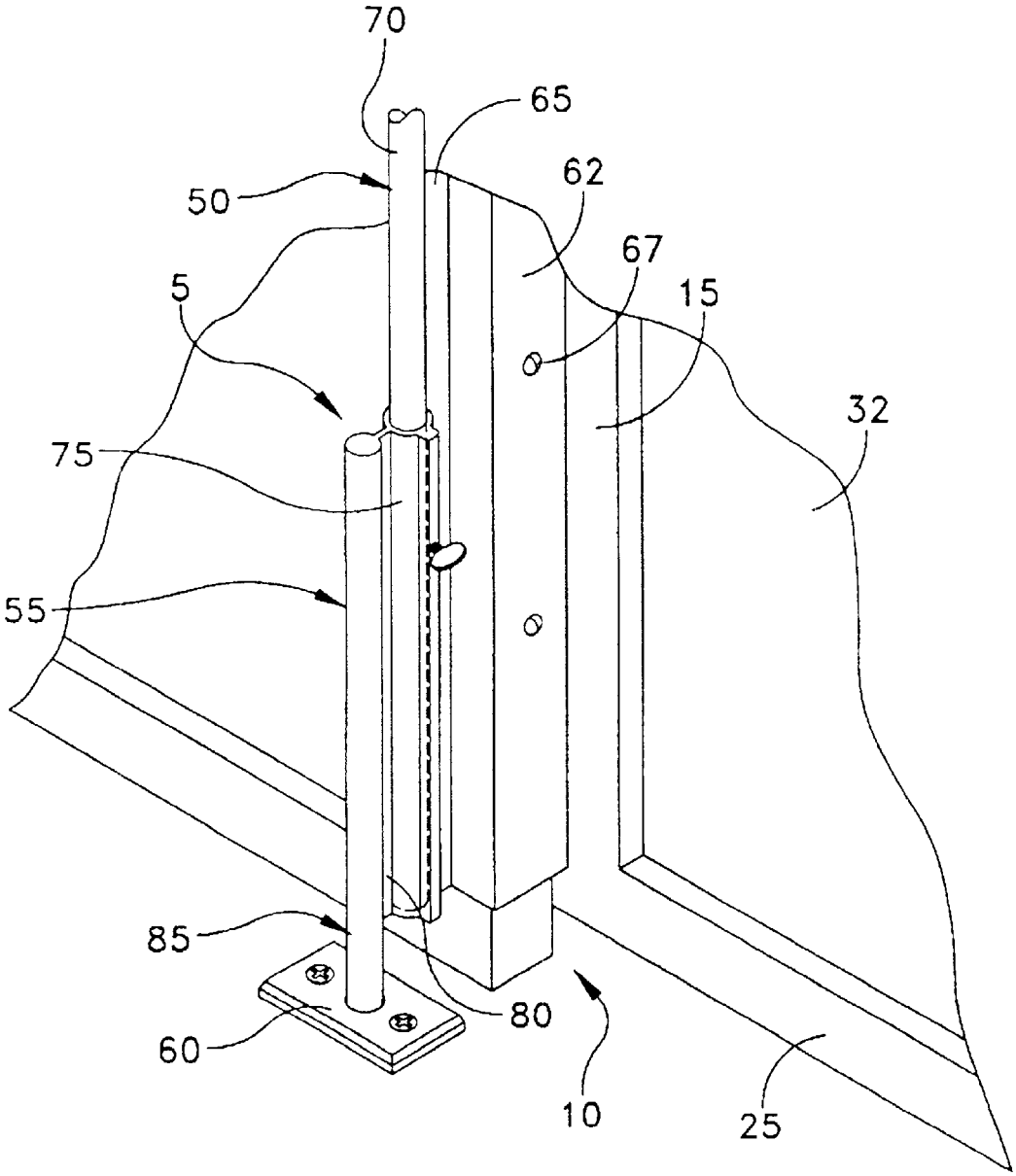
FIG. 2 is a broken away, perspective view of the sliding door and storm rail shown in FIG. 1, with the slide-bolt in a first position.
Figure 3:
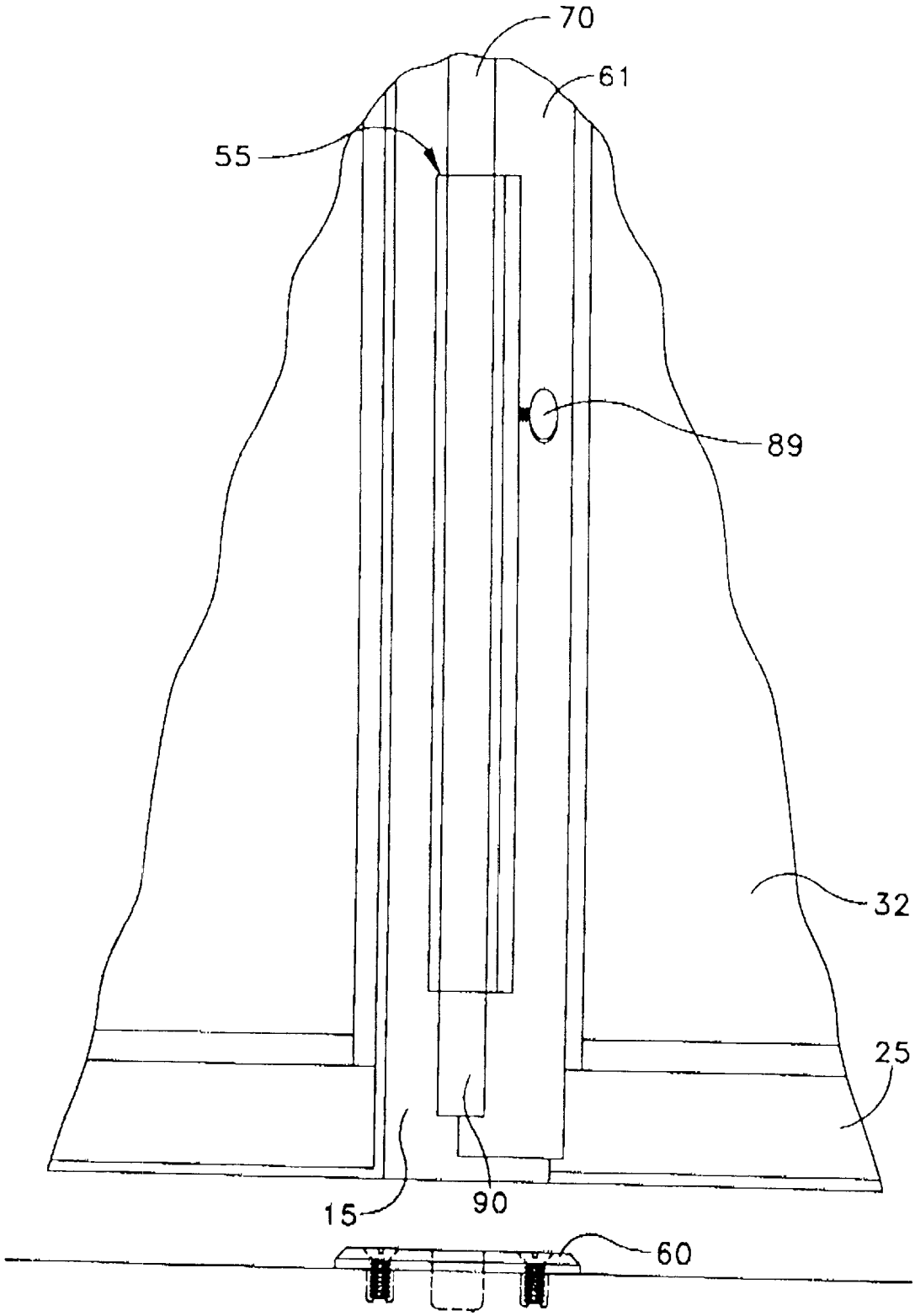
FIG. 3 is a broken away, front elevational view of the sliding door and storm rail shown in FIGS. 1, with the slide-bolt in a second position.
Figure 4:
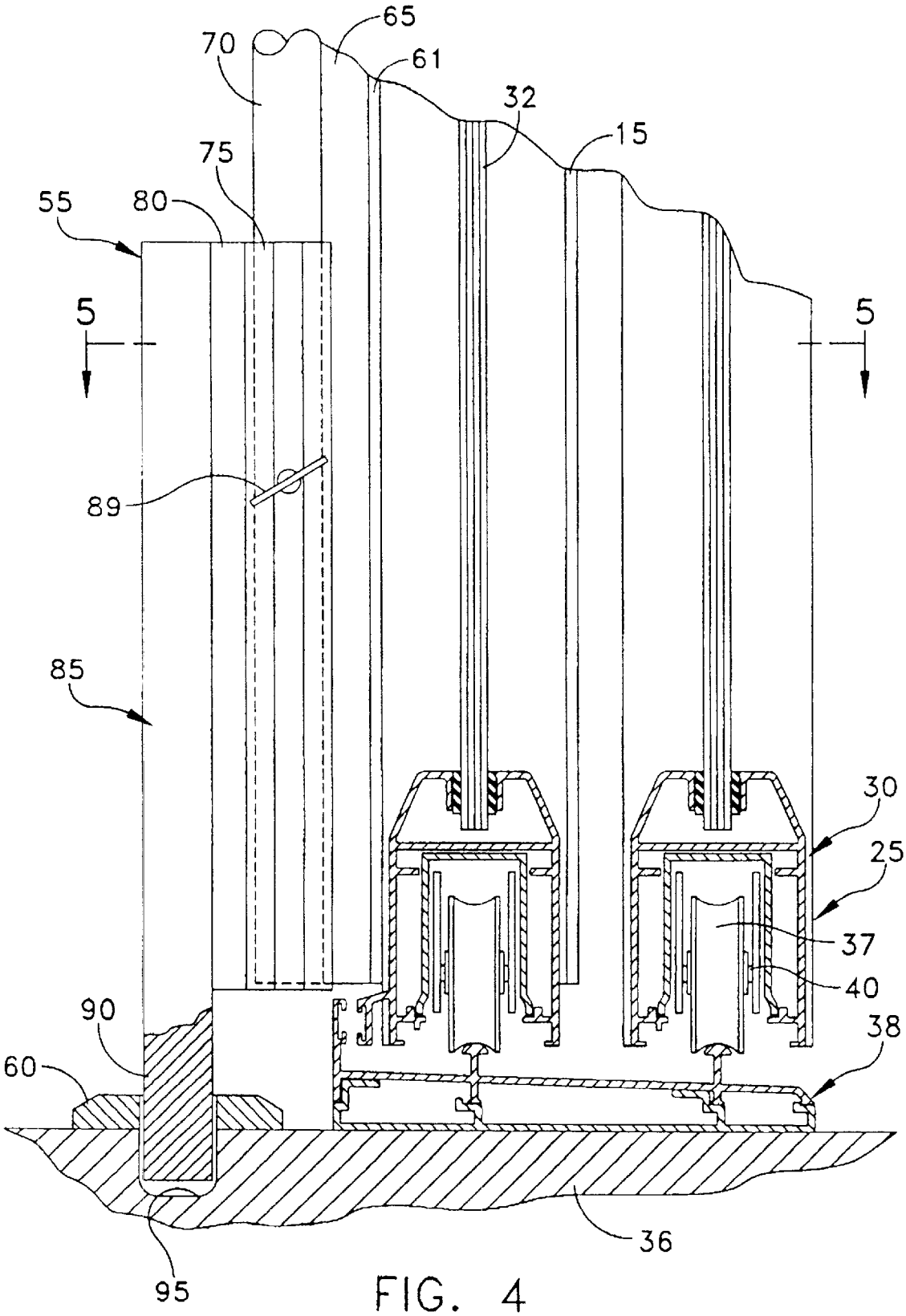
FIG. 4 is a broken-away, side elevational view of a lower portion of the storm rail shown in FIG. 1.

In FIGS. 1 and 2, a storm rail assembly 5 is shown for use in securing a sliding door 10 of the type that includes two vertical stiles 15, a horizontal top rail 20, and a horizontal bottom rail 25 carried on a roller assembly 30 (FIG. 4). At least one of the door panels between two stiles 15 is slidable between a closed position shown in FIG. 1, at which one of the vertical stiles 15 is intermediate the lateral sides of the door opening, and an open position in which the stile may be located at a different position, e.g., in registry with a second panel. Sliding doors of this type, often referred to a patio doors, have a pane of glass 32 mounted in the panel, and two or more panels are typically fitted within a rectilinear opening that is defined in a wall of a building structure 31 by top and bottom sills and side sashes of the type that are well known in the art. Usually, both panels are movable in sliding tracks, although one panel can be movable and the other stationary. When a door with two or more movable panels is closed, the panels are slid to fill the opening laterally, with adjacent panels lapping one another slightly, e.g., by the width of the vertical stiles. The door is opened by sliding one or both panels inwardly from the lateral sides of the opening, lapping one another more or less to define the extent to which the panels cover the area of the opening.

For example, each of sliding doors 10 as shown has its own rectangular frame extending about its periphery and a glass panel 32 mounted in each frame. Glass panel 32 may comprise a single glaze or glass sheet, or two or more glazes or sheets that are spaced and sealed for improved insulating characteristics. Sliding doors 10 are mounted for sliding movement in a door frame 36 which is also rectangular. Door frame 36 supports an interior sash track 38. Roller assembly 30 is positioned within horizontal bottom rail 25 of each sliding door 10, and typically comprises at least one wheel 37 rotatably supported on an axle 40, and adapted for rolling engagement on a sash track 38 that is fastened to the lower door sill.

Sliding doors 10 can be of known construction, and a detailed description is therefore unnecessary. It can be noted, however, that horizontal top and bottom rails 20, 25 and vertical stile 15 can be made of a variety of materials including a metal such as aluminum or aluminum alloy, a plastic such as polyvinyl chloride (PVC), or wood, etc. When these frame members are made from metal or plastic, they are generally made by an extrusion process and have a hollow profile. Although horizontally sliding doors are illustrated, the invention can also be employed with vertically sliding doors having sash balances or locks apart from the invention for holding them closed. The invention can contribute to locking, but more importantly, the invention provides structural reinforcement to a movable panel window by means of a structure that abuts against and supports an intermediate stile between the opposite edges of the opening, and may be retrofit to existing sliding doors. The reinforcement is obtained by providing a reinforcing member that engages against the intermediate stile, preferably encloses partway around and is attached to the vertical stile, is structured to resist bowing, and has movably adjustable bolt fixtures for engaging at least one of the header and the sill, and preferably both the header and the sill.

Storm rail assembly 5 may be formed from an extruded metal, e.g., aluminum or aluminum alloys, and comprises a rail 50, a slide-bolt 55, and at least one bolt plate 60. Rail 50 can be a particular form that in cross section defines a channel that is dimensioned to fit around the vertical stile, and an elongated solid bar or rod that is integral with the channel. Rail 50 typically is extruded as a single, elongate structural member that comprises a channel portion 62, a web 65, and a continuous vertical handle 70 in an integral form.

Figure 5:
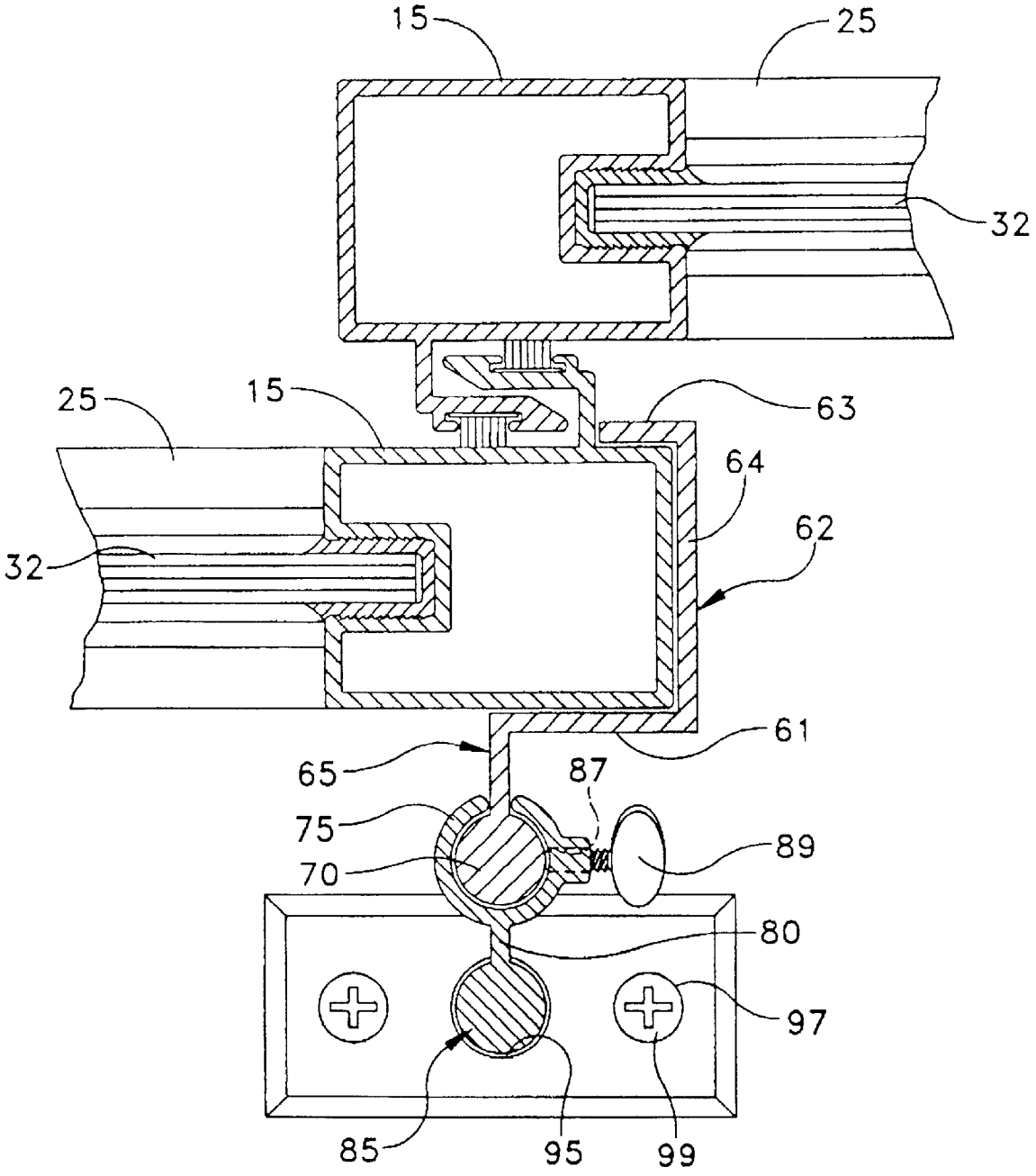
FIG. 5 is a top cross-sectional view taken through a lower portion of the storm rail shown in FIG. 1.
Figure 6:
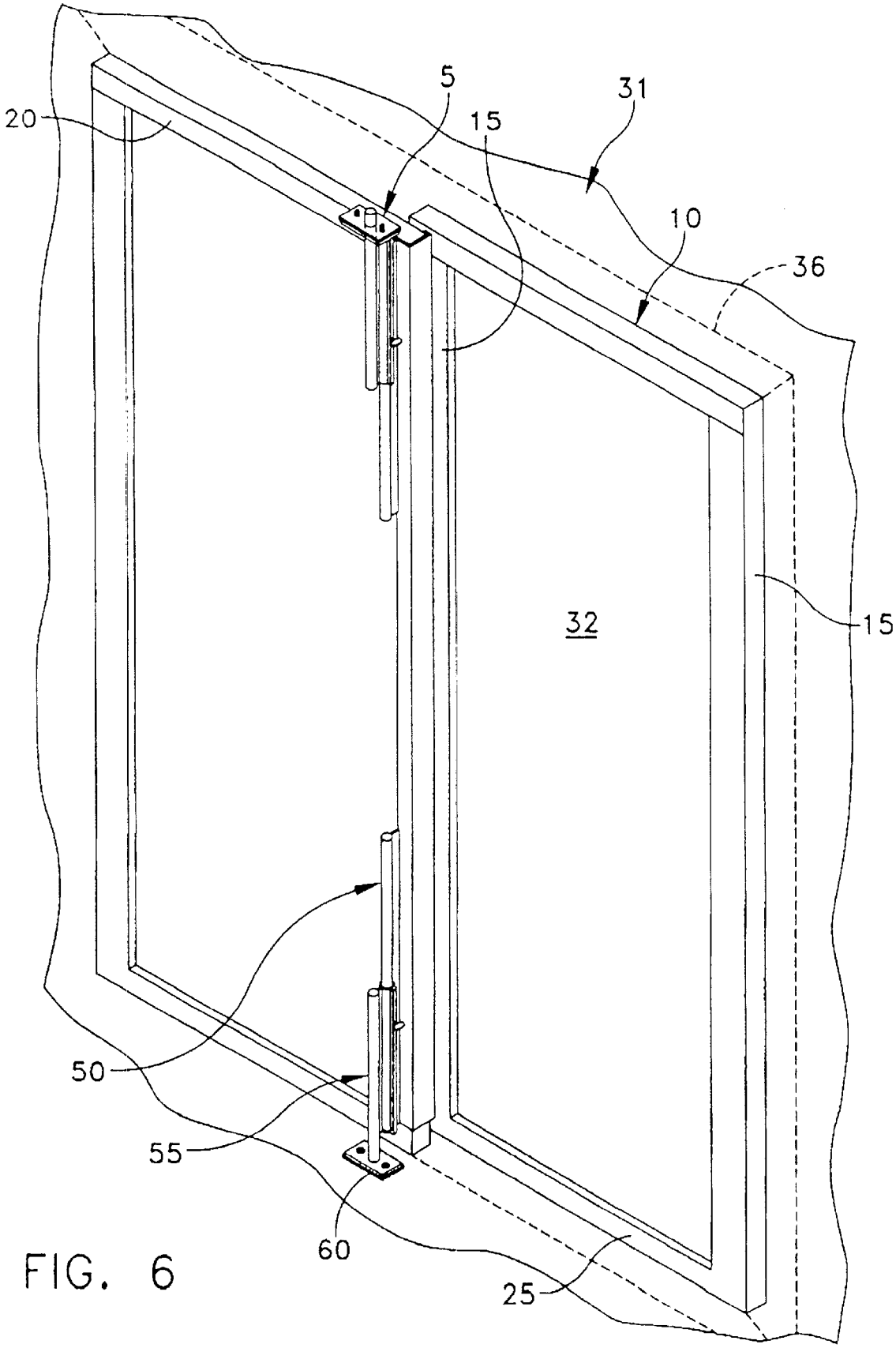
FIG. 6 is a perspective view of a sliding door including a storm rail support brace formed in accordance with an alternative embodiment of present invention.

Referring to FIG. 5, channel portion 62 includes flanges 61, 63, and a web 64, and is sized and shaped so as to be snugly positioned over the outer end of a vertical stile 15 of a sliding door 10, preferably an intermediate vertical stile, on one or both of the inside or outside of the door (preferably the inside only). Channel 62 can be rectilinearly shaped and complementary to the outer shape of vertical stile 15, or can be shaped to less fully engage the stile. For example, channel 62 can comprise an angle iron bar that bears against the inner corner of stile 15, or a flat bar against which stile 15 bears in the event of a sufficient force to cause stile 15 to begin to bow. Preferably, channel 62 encloses around at least part of at least three faces of stile 15, and may include a plurality of through-bores on any one or more of these faces, sized to accept screws or bolts 67 for removably attaching rail 50 to vertical stile 15, as will hereinafter be disclosed in further detail. Web 65 projects outwardly from an edge of flange 61, and extends along that edge for the entire length of channel 62. The solid body of web 65 extends inwardly and is elongated vertically. Thus web 65 acts like the web of an I-beam to resist bowing. Continuous vertical handle 70 is attached or integral with the end of web 65 such that handle 70 is spaced from channel 62, and also extends along the entire length of channel 62. Continuous vertical handle 70 in the embodiment shown comprises an elongated solid cylindrical bar and may comprise a circular or polygonal cross-section and preferably is solid but may comprise a tube. Storm rail assembly 5 also may comprise two rails 50, as shown in FIG. 6, each extending for a short distance at the top and bottom of channel 62. It is possible to provide an arrangement in which channel 62 is also discontinuous and extends only for a distance at the top and bottom of stile 15; however for the desired protection against bowing it is desirable that channel 62 be continuous or substantially continuous at least over an intermediate portion of stile 15 and preferably from top to bottom.

Referring to FIGS. 2–5, slide-bolt 55 typically comprises an extruded single structural member that comprises a channel 75, a web 80, and a bolt 85. Channel 75 has a cross-sectional shape that corresponds to the outer cross-sectional shape of continuous vertical handle 70, and is sized to be slidingly positioned over at least a portion of continuous vertical handle 70. A threaded through-bore 87 is defined in a portion of channel 75, for accepting a releasable fastener, such as thumb screw 89 or the like. Web 80 projects outwardly from a rear side surface of channel 75, and extends along the length of channel 75. Bolt 85 is attached to web 80 and positioned in spaced parallel relation to channel 75. Bolt 85 extends along the entire length of channel 75, and includes a locking rod 90 (FIG. 4) that projects outwardly and beyond the end edges of both web 80 and channel 75. Bolt plate 60 includes a central through-bore 95 that is sized and shaped to accept an end portion of locking rod 90, and one or more through-bores 97 adapted to receive conventional fasteners 99, such as screws, nails, bolts, or the like. Bolt plate 60 is securely attached, preferably to both the floor structure at the sill and the header structure above. The mortise opening for receiving the bolt is sufficiently deep that when bolt 90 is dropped into the mortise it is unlikely that normal vibration and displacement could cause bolt 90 to rise above the level of bolt plate 60. In this manner, the invention stiffens the vertical stile against bowing and provide a structural connection between the stiffened composite structure of the vertical stile and the channel, web and handle and the sill and header via the bolt plates.

Storm rail assembly 5 is assembled to sliding doors 10 as follows. Two slide-bolts 55 are first assembled to each end of rail 50 by positioning the open end of channel 75 in coaxially-aligned relation with a respective end of rail 50, with each locking rod 90 directed axially away from rail 50, and sliding slide-bolts 55 inwardly toward one another on rail 50, where they can be temporarily fixed by the thumb screws 89. In this position, locking rod 90 does not project substantially beyond the corresponding end of rail 50.

When slide-bolt 55 positioned on rail 50, storm rail assembly 5 may be attached to an inner vertical stile 15 of one of outer sliding doors 10 (FIG. 1), namely to an intermediate vertical stile that is disposed between the lateral sides of the door assembly when the door is closed. More particularly, rail 50 is oriented so that flanges 61, 63 of channel portion 62 are parallel with the side surfaces of vertical stile 15. In this position, web 64 of channel portion 62 is positioned in confronting spaced relation with the outer surface of vertical stile 15. Rail 50 is then moved toward vertical stile 15 so that flanges 61, 63 slide over and along the side surfaces of vertical stile 15. Rail 50 is moved toward vertical stile 15 until web 64 contacts vertical stile 15. Fasteners, such as screws 67, bolts, or the like, preferably are driven through rail 50 into vertical stile 15, although it is also possible to employ a frictional connection with the vertical stile. It is also possible, but not preferred, to have rail 50 simply abut against the stile 15 rather than to attach to it. It should be understood that fasteners 67, may be placed in through-bores in channel portion 62 to ease assembly of storm rail assembly 5 to sliding doors 10.

Two bolt plates 60 are positioned in the door frame sills, one adjacent to horizontal top rail 20 and one adjacent to horizontal bottom rail 25 of sliding doors 10. In this position, central through-bore 95 of bolt plate 60 is oriented in substantially coaxial relation with each locking rod 90 of each slide-bolt 55. In this way, each slide-bolt 55 may be released from rail 50 (by unscrewing thumb screw 89) and slid (downwardly or upwardly) toward a respective bolt plate 60, so as to position each locking rod 90 within central through-bore 95. Once in this position, thumb screw 89 can be tightened to fix slide-bolt 55 in place.

Once slide-bolts 55 are releasably locked in position in each bolt plate 60, and thereby structurally secured to the upper and lower sills of sliding door 10, slide rail assembly 5 acts as an additional structural support member for sliding door 10, both stiffening stile 15 and fixing its position relative to the structures surrounding the door opening. This is substantially more secure than the rather minimal structural engagement between the supporting rollers and their tracks (see FIG. 4). In particular, forces or pressures that are applied to the outer surface of sliding door 10 and might either displace the panels from their plane or even bow the vertical stile 15, are opposed by slide rail assembly 5, rather than by the engagement of wheels 37 with sash track 38. Moreover, the present invention may be easily assembled to sliding doors that are currently installed in a building without any need to modify their structure or the structure of the building. Slide rail assembly 5 may be unlocked by retracting slide-bolts 55 so that locking rods 90 are no longer positioned in the central through-bore 95 of each bolt plate 60, and preferably fixed with the thumb screws.

It is to be understood that the present invention is by no means limited only to the particular constructions herein disclosed and shown in the drawings, but also comprises any modifications or equivalents within the scope of the claims.

What is claimed is:

1. A support brace for structurally linking a sliding door to a surrounding structure, the sliding door having a panel that slides in a frame of the surrounding structure, in a direction parallel to a plane of the panel, the support brace comprising:

an elongated rail having a first end and a second end, said rail defining a channel along at least part of a length of the rail, the channel having flanges spaced in a direction perpendicular to said plane of the panel, such that the channel extends around opposite sides on an edge of the panel, whereby the rail is affixable to the panel at the edge, with said first end positioned adjacent to one end edge of said sliding door and said second end positioned adjacent to an opposite end edge of said sliding door;

at least one bolt slidingly secured to said rail and including a locking rod wherein said bolt can be slid along said rail between a first position wherein said locking rod projects beyond one of said first and second ends of said rail, and a second position wherein one of said first and second ends of said rail projects beyond said locking rod; and at least one lock plate including an opening defined through a portion of said plate, said opening being arranged in aligned relation to said locking rod so that when said bolt is slid from said second position to said first position, said locking rod is received in said opening.

2. A support brace according to claim 1 wherein the panel is horizontally slidable in the frame and said rail includes a continuous vertical handle, a channel portion defining said channel, and a web interconnecting said continuous vertical handle and said channel portion.

3. A support brace according to claim 1 wherein said channel portion is sized and shaped so as to be snugly and removably positionable over an outer end of a stile of a movable panel of said sliding door.

4. A support brace according to claim 1 wherein said includes a plurality of through-bores for receiving fasteners whereby the channel is further securely attachable to said stile.

5. A support brace according to claim 4 wherein said web projects outwardly from an edge, and extends along an entire length of said channel.

6. A support brace according to claim 5 further comprising a continuous vertical handle attached to an end of said web.

7. A support brace according to claim 6 wherein said continuous vertical handle comprises an elongated cylindrical bar.

8. A support brace according to claim 6 wherein said continuous vertical handle comprises a polygonal cross-section.

9. A support brace according to claim 1 wherein said rail comprises two continuous vertical handles positioned in spaced apart aligned relation.

10. A support brace according to claim 1 wherein said at least one bolt comprises a channel portion and a web projecting outwardly therefrom and further wherein said locking rod is secured to said web.

11. A support brace for structurally linking a horizontally sliding door to a surrounding structure at an edge of the sliding door spaced between laterally spaced parts of the surrounding structure, comprising:

a rail having a first end and a second end, said rail being removably attachable to the edge of said sliding door so that said first end is adjacent to a top edge of said sliding door and said second end is adjacent to a bottom edge of said sliding door, said rail defining a channel over at least a part of a length between the first end and the second end, wherein the rail extends around and engages against opposite sides of the sliding door at the edge;

at least one bolt slidingly secured to said rail adjacent to each of the first and second ends, said bolts each including a locking rod wherein said bolt can be slid along said rail between a first position wherein said locking rod projects beyond one of said first end of said rail, and a second position wherein one of said first end of said rail projects beyond said locking rod; and two lock plates each including an opening defined through a portion of said plate, each of said openings being arranged in aligned relation to one of said locking rods so that when said bolt is slid from said second position to said first position, said locking rod is received in said opening.

12. A storm resistant sliding door assembly comprising, in combination:

at least one horizontally sliding door panel including a pair of spaced-apart vertical stiles, a horizontal top rail, a horizontal bottom rail, a roller assembly, and a pane of glass forming a movable door panel that is displaceable between open and closed positions in a frame, at least one of the vertical stiles being an intermediate stile disposed at a space between lateral sides of the frame when the door assembly is closed;

an elongate rail having a first end and a second end, said rail defining a channel that encloses around opposite sides of said intermediate stile so that said first end is positioned adjacent to said horizontal top rail of said sliding door and said second end is positioned adjacent to said horizontal bottom rail of said sliding door;

at least one bolt slidingly secured to said rail and including a locking rod wherein said bolt can be slid along said rail between a first position wherein said locking rod projects beyond said horizontal bottom rail of said sliding door, and a second position wherein said locking rod is spaced from said horizontal bottom rail; and at least one lock plate including an opening defined through a portion of said plate, said opening being arranged in aligned relation to said locking rod when the door assembly is closed so that when said bolt is slid from said second position to said first position, said locking rod is received in said opening.

13. The assembly of claim 12, wherein the rail is attached to the intermediate stile exclusively by engagement of the channel around the intermediate stile on an inside and outside side of the panel, whereby the rail is readily installed and removed.

14. The assembly of claim 12, wherein the rail is attached to the intermediate stile by at least one fastener in addition to engagement of the channel around the intermediate stile on an inside and outside side of the panel.

* * * * *